US011204036B2

(12) United States Patent
Alers

(10) Patent No.: US 11,204,036 B2
(45) Date of Patent: Dec. 21, 2021

(54) PUMPING UNIT AND METHOD FOR CONTROLLING SUCH A PUMPING UNIT

(71) Applicant: Ateliers Busch SA, Chevenez (CH)

(72) Inventor: Paul Alers, Porrentruy (CH)

(73) Assignee: ATELIERS BUSCH SA, Chevenez (CH)

( * ) Notice: Subject to any disclaimer, the term of this patent is extended or adjusted under 35 U.S.C. 154(b) by 699 days.

(21) Appl. No.: 14/382,810

(22) PCT Filed: Mar. 5, 2013

(86) PCT No.: PCT/EP2013/054396

§ 371 (c)(1),
(2) Date: Sep. 4, 2014

(87) PCT Pub. No.: WO2013/131911

PCT Pub. Date: Sep. 12, 2013

(65) Prior Publication Data

US 2015/0204332 A1 Jul. 23, 2015

(30) Foreign Application Priority Data

Mar. 5, 2012 (CH) ..... 00285/12

(51) Int. Cl.
*F04C 29/04* (2006.01)
*F04C 18/10* (2006.01)
(Continued)

(52) U.S. Cl.
CPC ..... *F04C 29/04* (2013.01); *F04B 37/02* (2013.01); *F04B 37/14* (2013.01); *F04B 41/06* (2013.01);
(Continued)

(58) Field of Classification Search
CPC ..... F04B 37/02; F04B 37/14; F04B 41/06; F04C 18/10; F04C 18/126; F04C 18/16;
(Continued)

(56) References Cited

U.S. PATENT DOCUMENTS 2,971,691 A * 2/1961 Lorenz ..... F04B 37/14 417/280
3,799,181 A * 3/1974 Maddren ..... F16K 31/02 137/1
(Continued)

FOREIGN PATENT DOCUMENTS

DE 19500823 A1 7/1996
DE 10225774 C1 12/2003
(Continued)

OTHER PUBLICATIONS

International Search Report dated Apr. 17, 2013 for PCT/EP2013/054396.

*Primary Examiner* — Dominick L Plakkoottam
(74) *Attorney, Agent, or Firm* — Pearne & Gordon LLP

(57) ABSTRACT

A pumping installation includes at least one first positive-displacement machine and one second positive-displacement machine, as well as a control module, in which installation a gas is evacuated from an enclosed volume by means of the first positive-displacement machine and/or the second positive-displacement machine. The pumping installation includes at least one control valve controlled by the control module and a pressure sensor for sensing the value of the pressure at the outlet of the first positive-displacement machine and/or a temperature sensor for sensing the value of the temperature at the outlet of the first positive-displacement machine in order to control the flow of gas between the enclosed volume and the outlet of the pumping installation.

14 Claims, 7 Drawing Sheets

(51) Int. Cl.

| | |
|---|---|
| ***F04C 28/24*** | (2006.01) |
| ***F04C 18/16*** | (2006.01) |
| ***F04B 37/14*** | (2006.01) |
| ***F04C 28/02*** | (2006.01) |
| ***F04C 23/00*** | (2006.01) |
| ***F04C 25/02*** | (2006.01) |
| ***F04B 41/06*** | (2006.01) |
| ***F04B 37/02*** | (2006.01) |
| *F04C 18/12* | (2006.01) |
| *F04C 18/344* | (2006.01) |

(52) U.S. Cl.
CPC ..... *F04C 18/10* (2013.01); *F04C 18/16* (2013.01); *F04C 23/005* (2013.01); *F04C 25/02* (2013.01); *F04C 28/02* (2013.01); *F04C 28/24* (2013.01); *F04C 18/126* (2013.01); *F04C 18/344* (2013.01); *F04C 2220/12* (2013.01); *F04C 2270/18* (2013.01); *F04C 2270/19* (2013.01)

(58) Field of Classification Search
CPC ..... F04C 18/344; F04C 2220/12; F04C 2270/18; F04C 2270/19; F04C 23/005; F04C 25/02; F04C 28/02; F04C 28/24; F04C 29/04
See application file for complete search history.

(56) References Cited

U.S. PATENT DOCUMENTS 3,854,998 A * 12/1974 Jacobs ..... A47L 15/16 134/191
4,480,965 A * 11/1984 Ishizuka ..... F04B 49/16 417/274
4,699,570 A * 10/1987 Bohn ..... F04B 41/06 417/22
4,850,806 A * 7/1989 Morgan ..... F04B 37/14 417/205
4,882,097 A * 11/1989 Shannon ..... B01F 3/04808 261/35
5,595,477 A * 1/1997 Amlinger ..... F04B 37/14 417/203
6,589,023 B2 7/2003 Royce et al.
7,814,922 B2 * 10/2010 Tollner ..... F04C 23/005 137/12
8,715,400 B2 * 5/2014 Haruna ..... B01D 53/0446 417/120
2003/0068233 A1 4/2003 Royce et al.
2003/0106532 A1 * 6/2003 Tian ..... F01L 9/02 123/446
2004/0075202 A1 * 4/2004 Muramatsu ..... F16F 7/112 267/140.14
2006/0130519 A1 * 6/2006 Little ..... F17C 7/02 62/612
2007/0068573 A1 * 3/2007 Cox ..... C12Q 1/6874 137/1
2007/0128047 A1 * 6/2007 Gonnella ..... F04B 13/00 417/2
2008/0145258 A1 * 6/2008 Metzger ..... F04C 29/04 418/88
2013/0171919 A1 * 7/2013 Shinohara ..... B01D 53/005 454/49
2013/0213890 A1 * 8/2013 Kelly ..... A61M 1/1696 210/646
2014/0326671 A1 * 11/2014 Kelly ..... A61M 1/1696 210/662
2015/0144539 A1 * 5/2015 Pudil ..... A61M 1/1696 210/85
2015/0367057 A1 * 12/2015 Gerber ..... B01J 20/34 210/739

FOREIGN PATENT DOCUMENTS

EP 0373975 A1 6/1990
EP 0752531 A1 1/1997
EP 1906023 A1 9/2006

* cited by examiner

PUMPING UNIT AND METHOD FOR CONTROLLING SUCH A PUMPING UNIT

TECHNICAL FIELD

In a general way, this invention relates to the field of positive-displacement machines and installations comprising such positive-displacement machines. This invention concerns in particular positive-displacement machines intended to receive compressible fluid (such as air) and able to be used and pumping machines.

Concretely, but not exclusively, this invention concerns pumping groups or pumping installations comprising at least one first positive-displacement machine and one second positive-displacement machine as well as the field of methods of control of pumping installations of this type.

BACKGROUND ART

A multitude of industrial methods or research (for example in the field of good, chemicals, pharmaceuticals, etc.) today require a more or less strong vacuum (typically in the range of between 1 and $10^{-4}$ mbar).

To achieve this vacuum, "vacuum pumps" have been used for many years, i.e. positive-displacement machines capable of removing the air (or a gas or a mixture of gases) more or less completely which is contained in an enclosed volume or sealed chamber (for example in a "clean room" used for the production of printed circuits).

Different types of vacuum pumps are known to date. Mentioned in particular among the best known and most common can be vane-type pumps, liquid ring pumps, spiral (or scroll) pumps and also lobe (or Roots) pumps. Each of these different types of vacuum pumps has certain advantages (and drawbacks) rendering them especially suitable for use in particular applications. As the features of the different types of vacuum pumps are well known to those skilled in the art, elaborating at length on the different properties does not seem necessary to us.

To improve particular performance of vacuum pumps, creation of pumping groups or pumping installations has also been known for a long time, notably by combining two or more vacuum pumps. Such a configuration typically consists of a pump referred to as "primary" which is connected to the chamber which must be evacuated and which achieves first a vacuum referred to as "primary", thus having pressure approximately in the range between 1 bar ($10^3$ mbar) and 1 mbar. Then the primary vacuum created by this primary pump is taken over by a pump referred to as "secondary", connected in series to the primary pump, which achieves a greater vacuum. The pressures at the exit of a secondary pump typically range between 1 and $10^{-4}$ mbar, even if lower pressures are also possible.

A typical installation including two pumps is a combination of a Roots pump with another pump, for example a screw pump. It is understood that configurations with three (or more) pumps are likewise possible, even installations with pumps connected in parallel or with a combination of connections in series or in parallel.

Besides the pumps, such a pumping group typically comprises one or more valves as well as an electronic and/or mechanical control module for controlling the flow of gas between the inlet and the outlet of the system. The installation features and features relating to the working together of the different elements in a conventional pumping group is likewise part of the typical knowledge of one skilled in the art in the technological field of vacuums such that a detailed description does not seem necessary here.

Now all the positive displacement machines used as vacuum pumps have the characteristic of heating up during their operation. On the one hand, the principle of operation of the majority of vacuum pumps makes the gases pumped heat up between the inlet and the outlet of the system owing to the forced volume reduction and a subsequent increase in their pressure. This increase in temperature of gases results directly from the laws of physics, and it cannot be completely eliminated. On the other hand, the secondary effects, such as the friction between the rotary elements in the pump, also result in an increase of the temperature of the same pump. This heating up again results in an increase in the temperature of gases inside pumps.

An elevated temperature within a pumping group is not desirable. It can in particular cause severe problems in operation of positive displacement machines owing, for example, to chemical and/or physical reactions of the gases pumped. Certain gases notably contain elements which can sublime or condense at elevated temperatures, thus producing residues inside the pumps. With time, these residues can result in a jamming or another malfunctioning of the pumps. Also a too high temperature inside the pumps is very unfavourable for an optimal efficiency of the pumps because of the fact that it can cause a great expansion of the metallic elements.

To overcome these drawbacks, different ways of cooling have been implemented in the various vacuum pumps. Thus there exist air-cooled pumps, in particular with ribs or other similar elements on their outer surface in order to increase the air on the surface exposed to the air and in order to promote the mechanical cooling of the pump by means of ambient air. Other pumps have cooling by means of liquid, in particular air or oil. For example in a lubricated vane pump, the vanes slide on a surface lubricated with oil. This oil serves at the same time the cooling of the contact surface in order to achieve an easier sliding and a cooling of the pump.

However, all these cooling mechanisms have a major disadvantage, notably the fact that they make the pumps at the same time more complex, more expensive and more susceptible to breakdown. Moreover the cooling liquids must be filtered, purified and/or changed from one time to another, which makes the maintenance of the pumps also more complicated and more costly.

SUMMARY OF INVENTION

The present invention thus has as object to propose a solution to this problem of elevated temperatures in vacuum pumps and/or in pumping groups without the use of complex cooling systems.

Another result that the present invention aims to achieve is a pumping installation whose performance is maintained over time.

To this end the invention has as subject matter an installation conforming to claim 1. The more detailed embodiments are defined in the dependent claims and in the description.

More concretely, the present invention concerns a pumping installation comprising at least one first positive-displacement machine and one second positive-displacement machine, as well as a control module, in which pumping installation a gas is evacuated from an enclosed volume by means of the first positive-displacement machine and/or the second positive-displacement machine, and where the pumping installation further comprises at least one control valve which is controlled by the control module in order to regulate the flow of gas between the enclosed volume and the outlet of the pumping installation.

The main advantage of the present invention resides in the fact that the pumping installation proposed has means able to control in a precise way the flow of gas to be pumped between the inlet and the outlet of the system. In this way the co-operation between the positive displacement machines can be adapted to the concrete needs of the situation, which makes control of the performance of the system very easy. Consequently it is also possible and easy to control the heating up of the positive displacement machines.

It must be pointed out here that the present invention concerns not only a pumping installation according to the aforementioned embodiments, but also a method of control of such a pumping installation.

BRIEF DESCRIPTION OF DRAWINGS

The invention will be better understood from reading the following description, given by way of non-limiting example, with reference to the attached drawings representing diagrammatically.

DETAILED DESCRIPTION OF THE INVENTION

Figure 1:
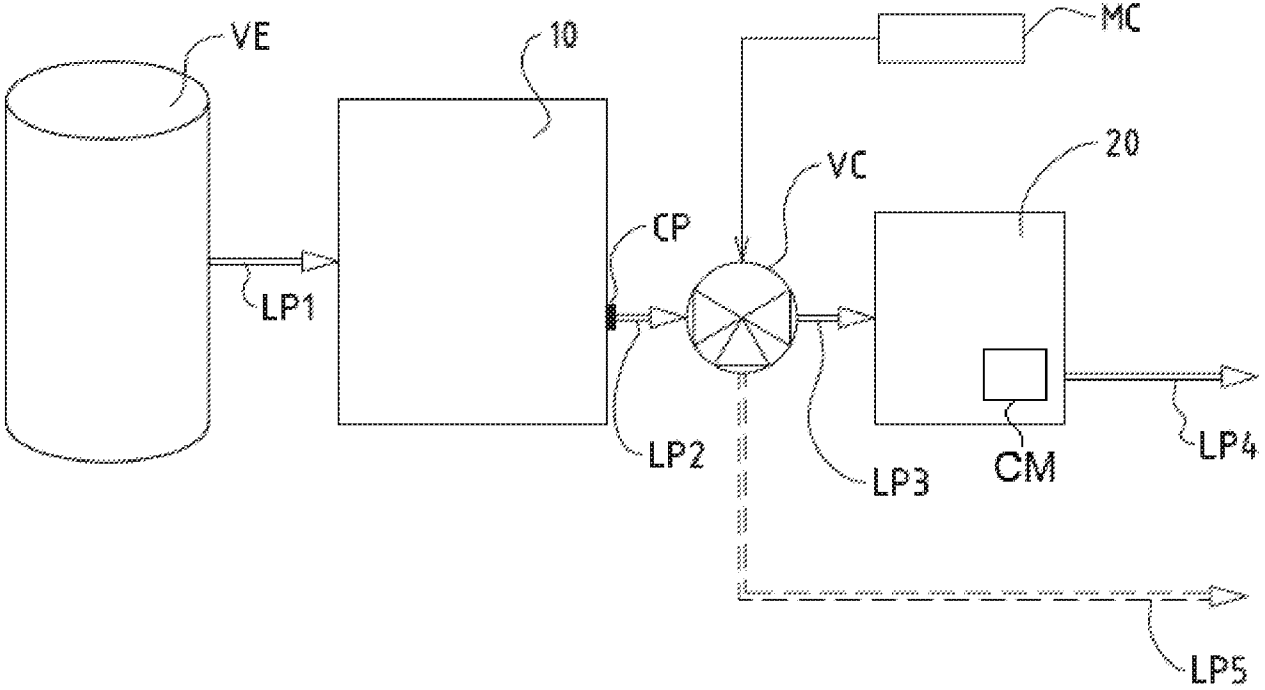
FIG. 1: a block diagram of a pumping installation according to a first embodiment of the present invention.

FIG. 1 represents a block diagram of a pumping installation IP according to an embodiment of the present invention. In FIG. 1, a first positive-displacement machine is represented in a simplified way by a rectangle bearing the reference symbol 10, and a second positive-displacement machine is represented by another rectangle bearing the reference symbol 20. Also shown in a schematic way in FIG. 1 is an enclosed volume VE which is evacuated with the aid of the pumping installation IP. This enclosed volume VE can correspond to a clean room (i.e. a room in which the temperature, the humidity and/or the pressure is controlled with the aim of creating and maintaining the necessary environmental conditions for diverse industrial or research applications), a production enclosure (for example in a machine tool) of any other volume in which the pressure must be controlled in a precise manner.

In the pumping installation IP according to the present invention, the first positive-displacement machine 10 can be in particular a screw pump. A screw pump is composed essentially of two parallel screws which are driven in rotation in opposite directions. Owing to this rotation, the gases which are located inside the pump can be transported between the inlet and the outlet of the pump. Screw pumps are dry pumps, thus pumps in which the gases pumped never enter into contact with the lubrication liquids which could result in contamination. Thanks to this feature, screw pumps can be used in applications requiring an elevated degree of hygiene (for example in the food industry). Of course the positive-displacement machine 10 can be achieved by any other suitable type of pump.

This first positive-displacement machine 10 is connected the enclosed volume VE by means of a conduit (or pressure line) LP1. This conduit LP1 can correspond in particular to a conventional pipe, of metal or any other suitable material. Of course other types of pipe or tube LP1 are also possible. The first positive-displacement machine 10 is thus disposed and configured to evacuate the air (or any other gas inside the enclosed volume VE) directly and to discharge it at its outlet which is typically achieved by an exhaust port.

Another conduit LP2 is connected to the exhaust orifice of the first positive-displacement machine 10. Like the conduit LP1 which connects the enclosed volume VE to the first positive-displacement machine 10, the conduit LP2 can be a conventional pipe, but could also be achieved in any other appropriate fashion. The conduit LP2 thus takes the gases to the outlet of the positive-displacement machine 10 and then channels them toward the second positive-displacement machine 20 via a third conduit LP3.

The second positive-displacement machine 20 which receives the flow of gases which have been evacuated from the enclosed volume by the first positive-displacement machine 10 via the conduit LP3 can be in particular a vane pump. Vane pumps are composed of a stator and a rotor with sliding vanes which turn tangentially with respect to the stator. During the rotation, the vanes remain in contact with the walls of the stator. The walls of the stator in one zone are covered with an oil bath which ensures at the same time the tightness of the pump and the lubrication of the moving parts. The vane pumps are thus not dry pumps, and the gases pumped can enter into contact with the lubricants. These pumps are therefore not typically used in applications having elevated standards of hygiene. Also the positive-displacement machine 20 here does not have to be a vane pump, and it can be achieve by another suitable type of pump.

The outlet (exhaust orifice) of the second positive-displacement machine 20 is connected to a fourth conduit LP4 which serves to evacuate the gases pumped by the second positive-displacement machine 20 to the outlet of the pumping installation IP. The conduit LP4 can also correspond to a conventional pipe, of metal or any other suitable material. Of course other types of pipe or tube are conceivable, even a solution in which the conduit LP4 is not provided and the gases exiting from the positive-displacement machine 20 are directed directly toward the outlet of the pumping installation IP.

In the pumping installation IP according to the present invention, a control valve VC is connected between the conduits LP2 and LP3, thus between the first positive-displacement machine 10 and the second positive-displacement machine 20. This control valve VC serves essentially to control the flow of the gases and in particular to prevent the flow of the gases pumped in "backward" direction, that is to say toward the positive-displacement machine 10. Such control valves are already known in the art and their operating principle can be based in particular on a check valve or non-return valve. Of course any other type of control valves can be used if these other valves satisfy the aforementioned conditions.

The control valve VC can, for its part, be controlled by an external control module MC. The control module MC is an electronic and/or mechanical device which enables controlling the operation of the control valve VC in order to control the flow of the gases between the conduit LP1 and the conduit LP2 and thus between the enclosed volume VE and the outlet of the pumping installation IP. To this end, a fifth conduit LP5 leading directly to the outlet of the pumping installation IP is also connected to the control valve VC.

Figure 2:
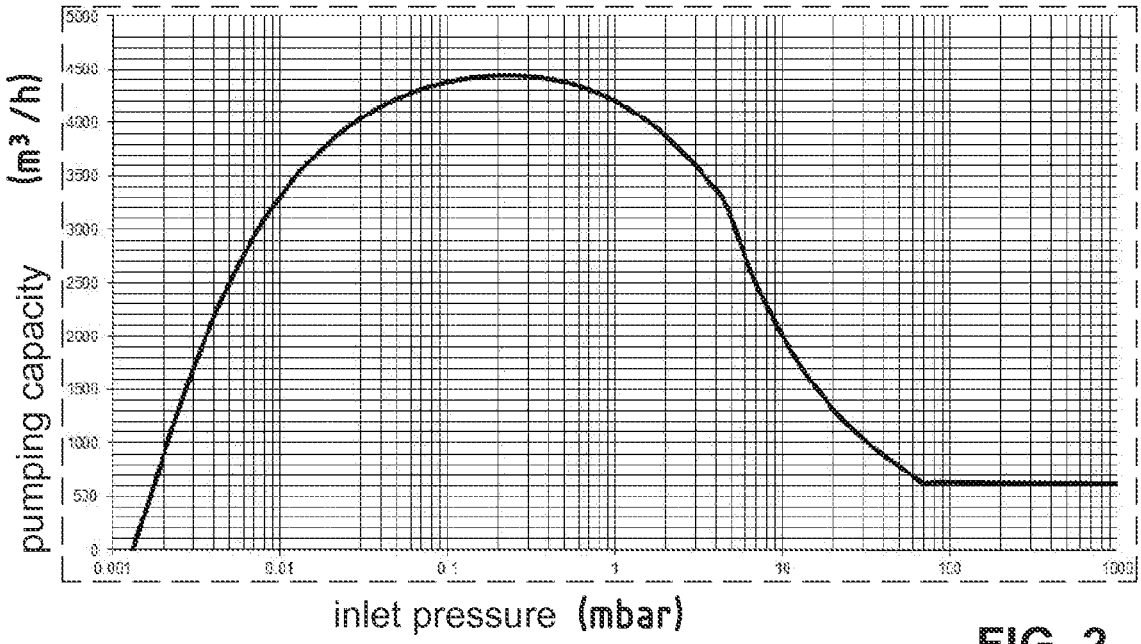
FIG. 2: a schematic diagram representing the development of the pumping capacity (also called "pumping rate") in the enclosed volume, evacuated solely with a first positive-displacement machine.

The pumping installation IP according to the present invention, such as shown in FIG. 1, functions in the following way: Upon start-up of the first positive-displacement machine 10, the gases are pumped from the enclosed volume VE. FIG. 2 represents in a schematic way a diagram of the development of the pumping (which is also called "pumping rate" of the pump) in the enclosed volume VE which is evacuated solely with this first positive-displacement machine 10.

Figure 3:
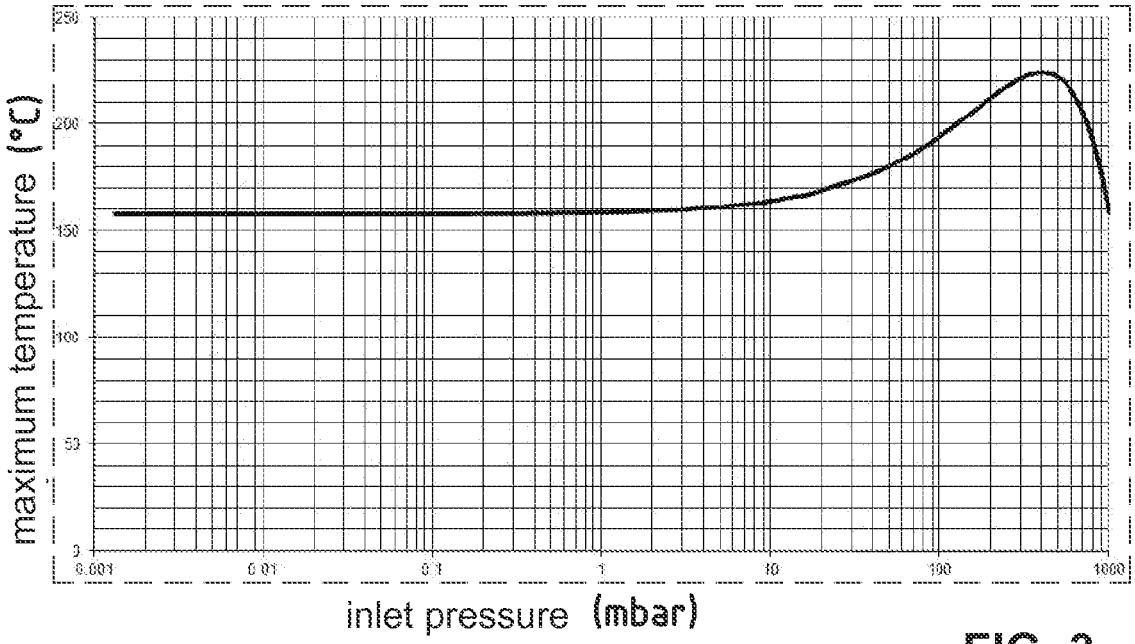
FIG. 3: a schematic diagram representing the development of the temperature of the first positive-displacement machine, corresponding to the development of the pumping capacity in FIG. 2.

It can easily be seen that the pumping capacity increases in a first operating range to decrease in a second operating range and finally remain constant after having attained a pressure limit. In parallel, FIG. 3 represents the development of the temperature in the first positive-displacement machine 10 which corresponds directly to the pumping capacity of the first positive-displacement machine such as represented in FIG. 2. When analysing this diagram, it is easy to note a clear increase in the temperature of the positive-displacement machine 10 starting with a pressure limit. As already mentioned in the introduction, a large increase in the temperature is generally disadvantageous.

Figure 4:
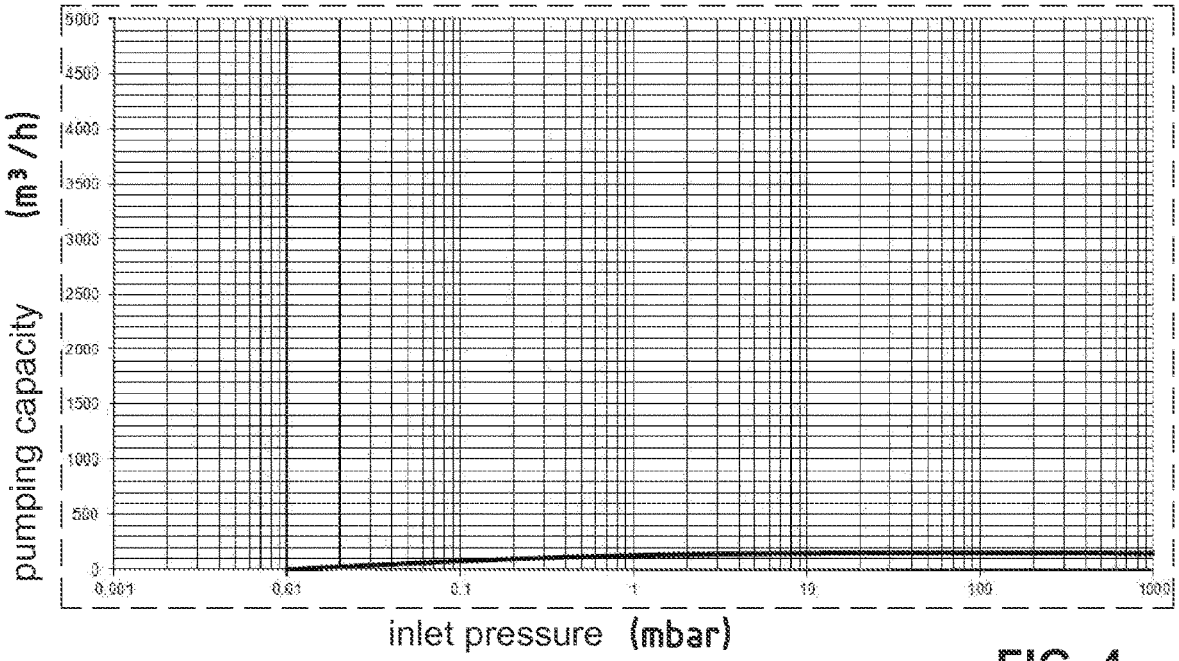
FIG. 4: a schematic diagram representing the development of the pumping capacity in the enclosed volume, evacuated solely with a second positive-displacement machine.
Figure 5:
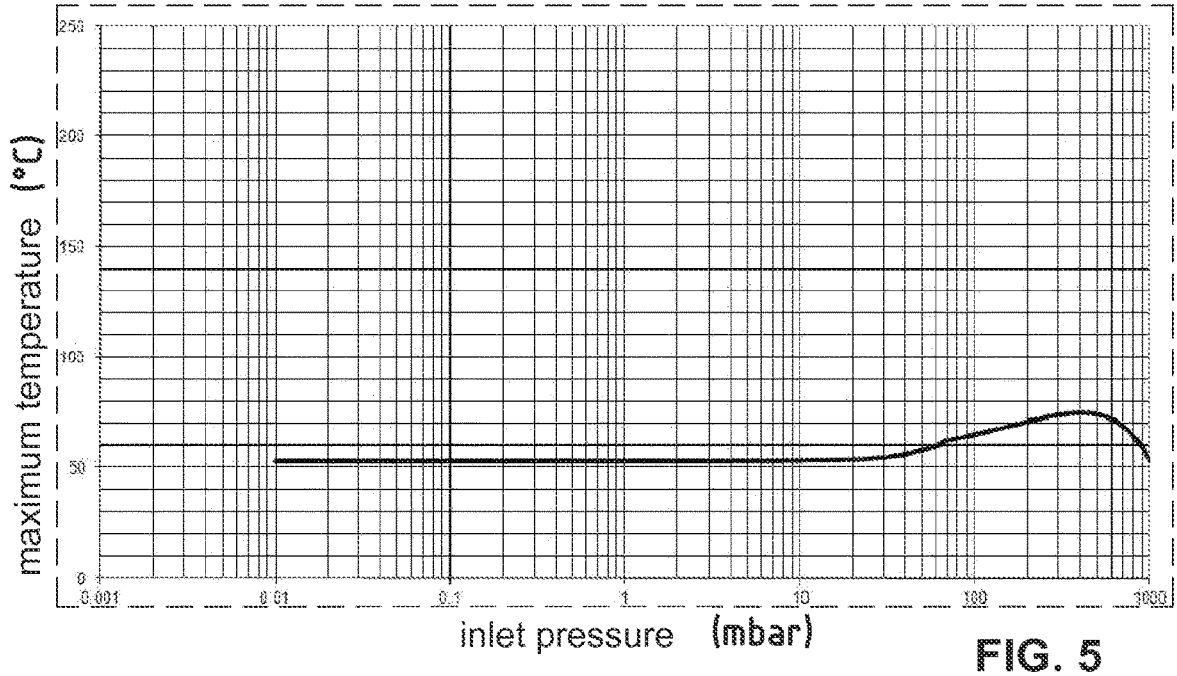
FIG. 5: a schematic diagram representing the development of the temperature of the second positive-displacement machine, corresponding to the development of the pumping capacity in FIG. 4.

FIG. 4 also shows a schematic diagram with the development of the pumping capacity in the enclosed volume VE, but in the case where this volume is evacuated solely with the second positive-displacement machine 20. The volume first travels through the first positive-displacement machine 10, which is not in operation, when the volume is evacuated solely with the second positive-displacement machine. Typically, this second positive-displacement machine 20 shows a rather constant development. However, the temperature in the second positive-displacement machine 20 develops in a way similar to that in the positive-displacement machine 10, i.e. shows a net increase of the temperature beyond a pressure limit.

To completely overcome this problem, the present invention proposes to regulate the control valve VC by means of the control module MC in order to switch the flow of gas between a first course in which the gas is pumped solely by the first positive-displacement machine 10 and a second course in which the gas is pumped at the same time by the first positive-displacement machine 10 and the second positive-displacement machine 20.

In the first case, the gas evacuated from the enclosed volume VE passes through the conduit LP1 and the first positive-displacement machine 10, arrives at the control valve VC through the conduit LP2 and is then directed directly toward the outlet of the pumping installation IP by means of the conduit LP5. In contrast thereto, the gas evacuated from the enclosed volume VE in the second case passes first through the conduit LP1, the first positive-displacement machine 10 and the second conduit LP2 to arrive at the control valve VC which does not direct it toward the outlet but toward the second positive-displacement machine 20. Then the gas pumped by the second positive-displacement machine 20 exits the pumping installation IP by means of the conduit LP4.

Normally, this switch is controlled in a temporal way. For example, in a first phase of operation, the pumping installation IP can operate as in the first case described above, that is with the gases which are pumped through the first course. Then, after a certain interval of time, the pumping installation IP can operate as in the second case described above, that is with the gases which are pumped through the second course.

The switching between the first course and the second course can be programmed in a "static" way. It would be possible, for example, to program a switch after an operation in the first mode of operation (course VE→LP1→10→LP2→VC→LP5) of 20 or 30 seconds. In this case, the control module will count the time passed from the start-up of the pumping installation and will give the instruction to the control valve after having reached the time pre-programmed to change the course of passage of the gases.

However, instead of using a static switching, it would also be possible to use a pressure sensor CP at the outlet of the first positive-displacement machine 10 and to switch the flow of gas after a certain pressure at the outlet of the first positive-displacement machine 10 has been detected. This pressure limit could be determined in a practical way for each concrete application and stored in the control module MC in order to be able to be used in the regulation of the control valve VC.

Figure 6:
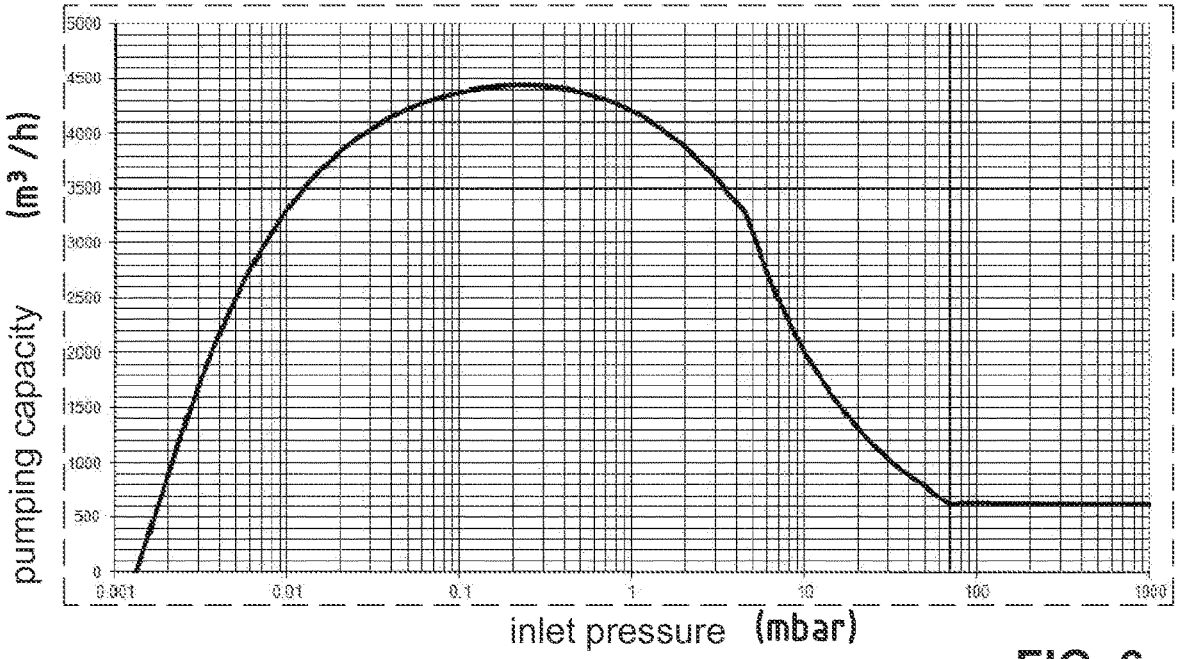
FIG. 6: a schematic diagram representing the development of the pumping capacity in the enclosed volume according to the present invention, evacuated at the same time with the first and the second positive-displacement machine.
Figure 7:
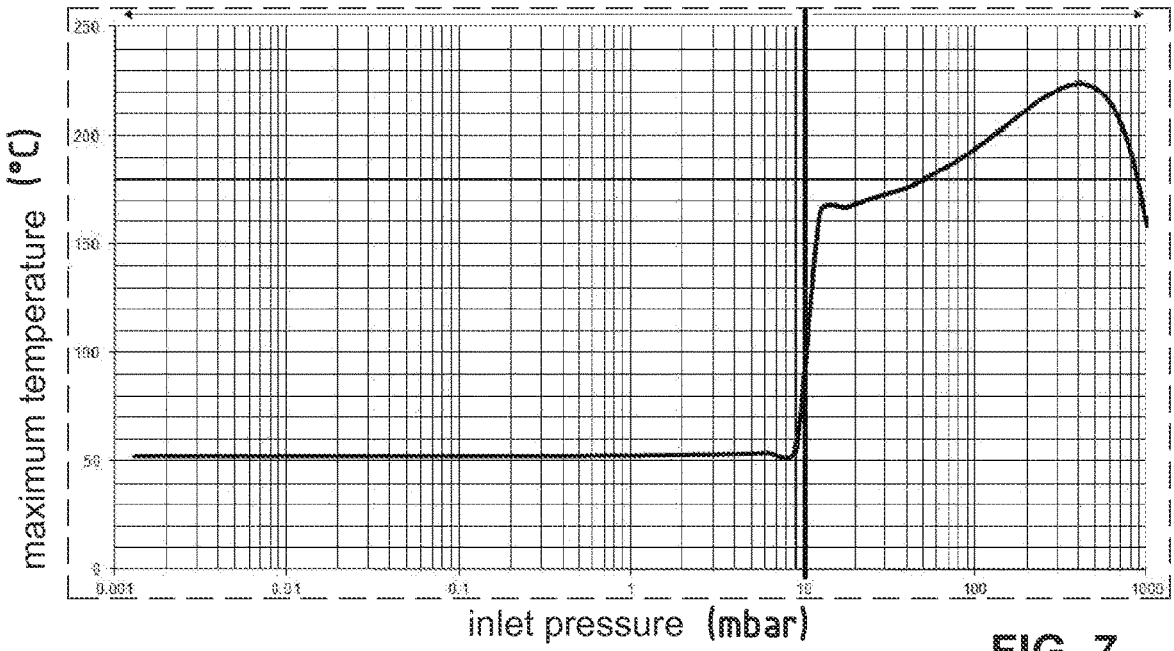
FIG. 7: a schematic diagram representing the development of the temperature of the first and of the second positive-displacement machine, corresponding to the development of the pumping capacity in FIG. 6.

FIGS. 6 and 7 show in a schematic way the development of pumping capacity in the enclosed volume VE when it is evacuated at the same time with the first positive-displacement machine 10 and the second positive-displacement machine 20, as well as the development of the corresponding temperature.

Figure 8:
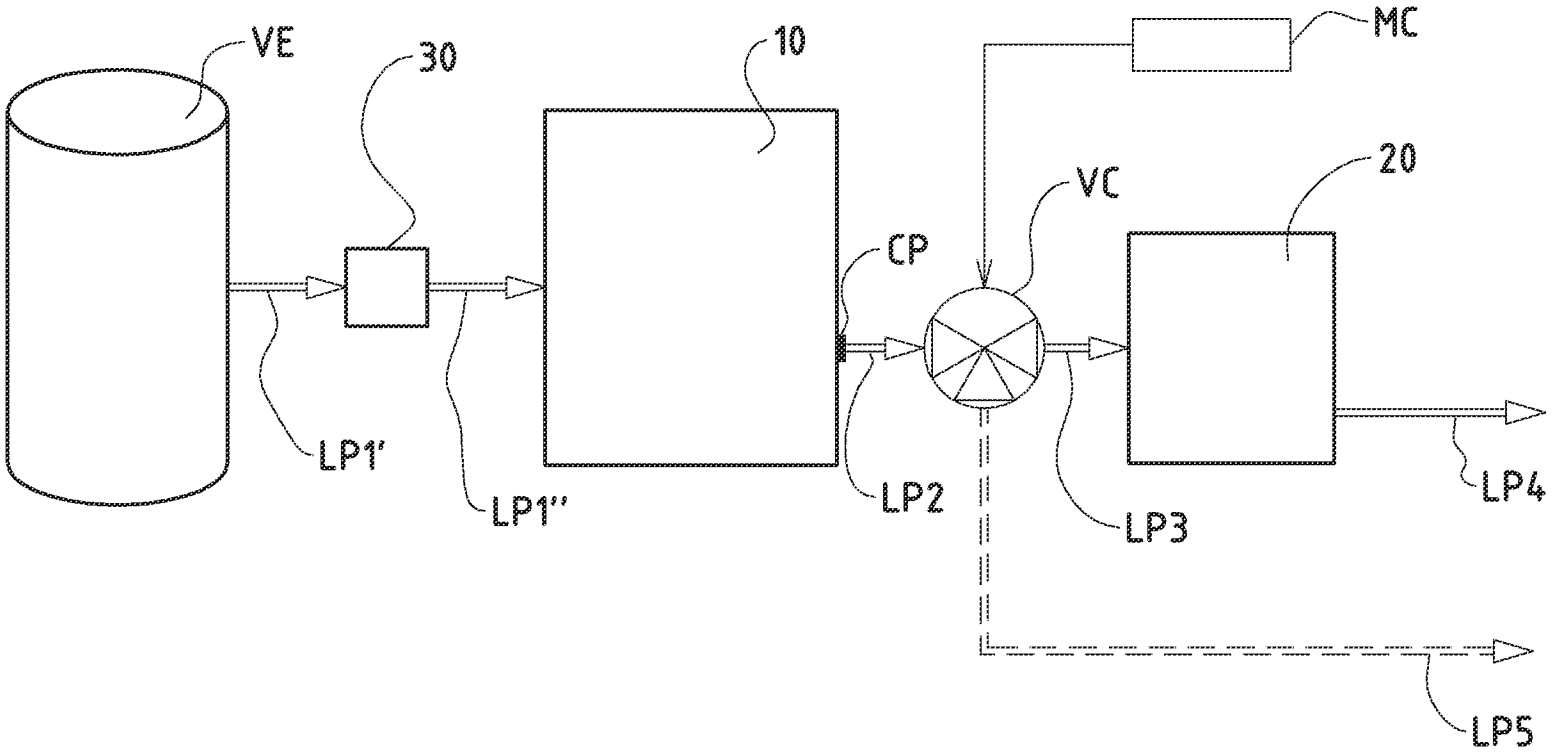
FIG. 8: a block diagram of a pumping installation according to a second embodiment of the present invention.

Finally, FIG. 8 illustrates a second embodiment of the present invention schematically. With respect to the first embodiment represented in FIG. 1, this second embodiment of the present invention comprises a third positive-displacement machine 30 which is interposed between the enclosed volume VE and the first positive-displacement machine 10. To this end, the conduit LP1 is divided into two parts, i.e. the conduits LP1' and LP1". Of course other options for the interconnection are absolutely conceivable.

This third positive-displacement machine 30 can be typically a Roots pump. Its operation corresponds to the operation of a "booster" pump which is used in a conventional way in the pumping installations known to date. It would of course also be possible to use another type de positive displacement machines or to add more of them, without departing from the spirit of the present invention.

Figure 9:
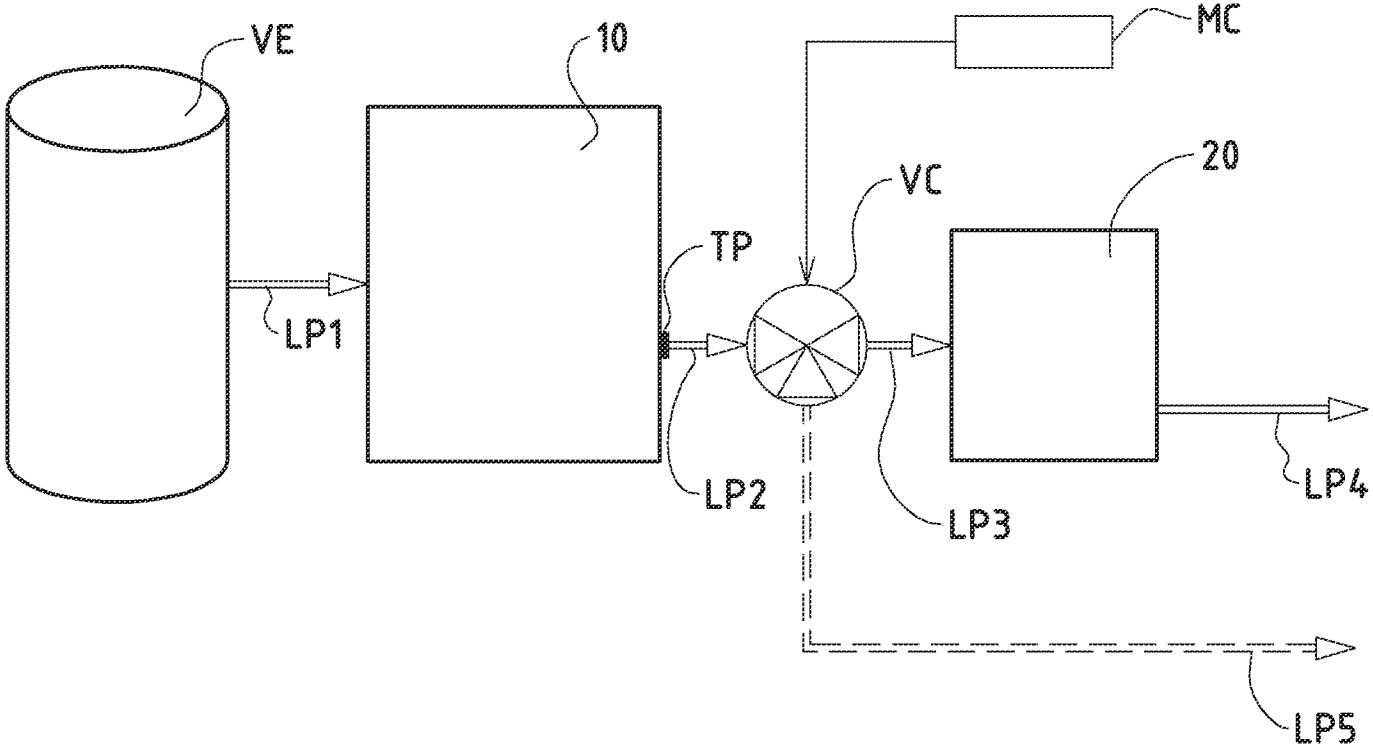
FIG. 9: a block diagram of a pumping installation according to a third embodiment of the present invention.
Figure 10:
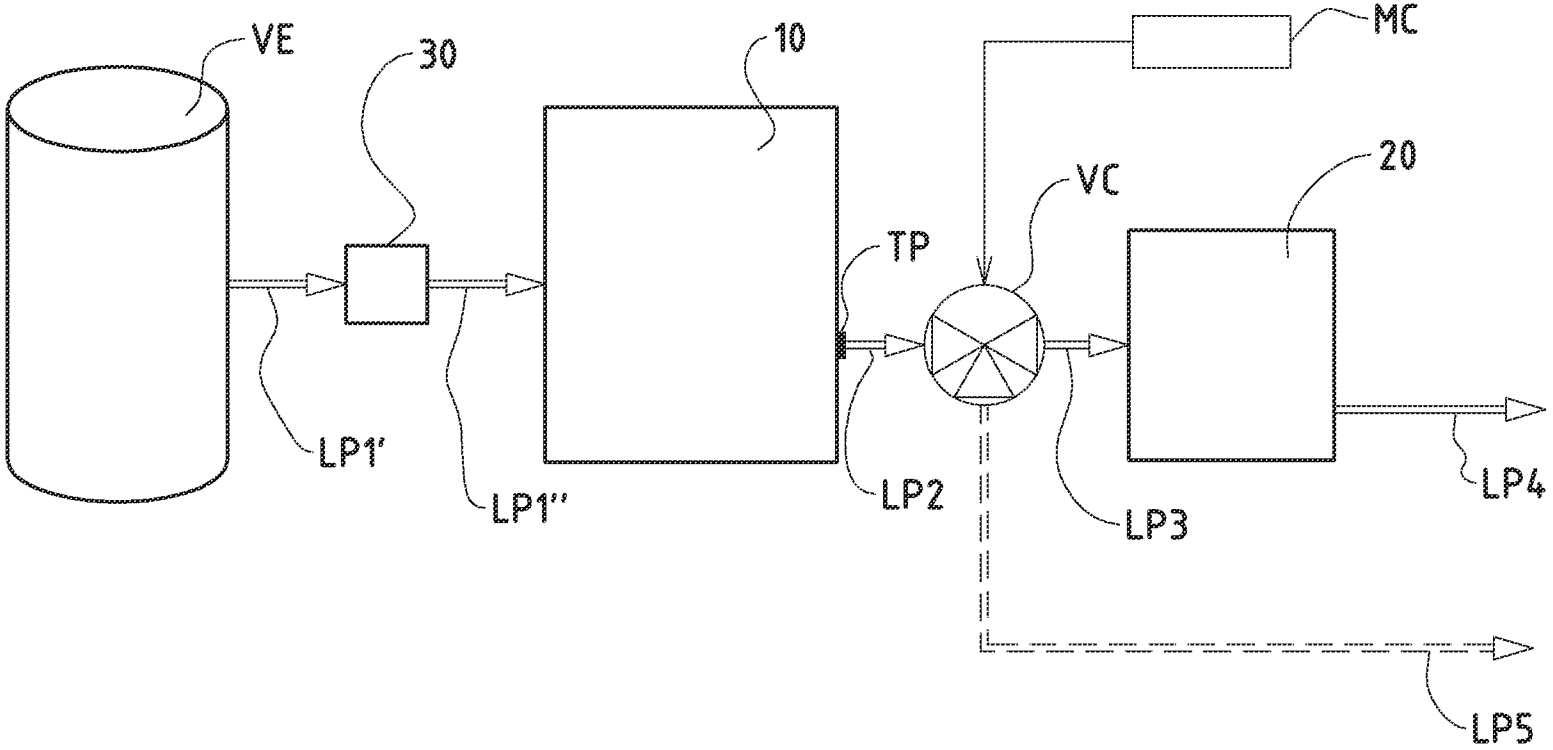
FIG. 10: a block diagram of a pumping installation according to a fourth embodiment of the present invention.

FIGS. 9 and 10 illustrate respectively a third and a fourth embodiment of the present invention. These two embodiments of the present invention differ from the first and from the second embodiment of the present invention in one significant point which will be explained further below.

In the third embodiment of the present invention, represented in FIG. 9, the pumping installation IP comprises also a first positive-displacement machine 10 and a second positive-displacement machine 20 which are used to evacuate the enclosed volume VE (in particular a clean room, a production enclosure or any other volume in which the pressure must be controlled in a precise way). As already mentioned with respect to the first embodiment of the present invention (represented in FIG. 1), the first positive-displacement machine 10 can be a dry pump, for example a screw pump, but also any other suitable positive-displacement machine. As concerns the second positive-displacement machine 20, it can be in particular a vane pump, but it is of course also possible to achieve this second positive-displacement machine 20 by means of another suitable positive-displacement machine.

A conduit or pressure line LP1, for example a conventional pipe, connects this first positive-displacement machine 10 to the enclosed volume VE. The outlet of the first positive-displacement machine 10 (in this case normally an exhaust port of the pump) is connected on its side to another conduit LP2 which can likewise be a conventional pipe, but also another suitable conduit. This second conduit LP2 takes the gases to the outlet of the positive-displacement machine 10 and channels them via a control valve VC toward the second positive-displacement machine 20. To this end, a third conduit LP3 is also provided to connect the control valve VC to the second positive-displacement machine 20.

As in the pumping installations according to the first or according to the second embodiment of the present invention, the outlet of the second positive-displacement machine 20 is connected to a fourth conduit LP4 which serves to evacuate the gases pumped by the second positive-displacement machine 20 to the outlet of the pumping installation. Again this conduit LP4 can also correspond to a conventional pipe, of metal or any other suitable material. Naturally other types of conduit are likewise conceivable, even a solution in which the conduit LP4 has not been provided and the gases exiting from the positive-displacement machine 20 are directed directly toward the outlet of the pumping installation IP.

As already mentioned, the control valve VC is connected between the first positive-displacement machine 10 and the second positive-displacement machine 20. Also in this third embodiment of the present invention the operation of this control valve VC is primarily to control the flow of the gases and in particular to prevent the flow of the pumped gases in "backward" direction, i.e. toward the positive-displacement machine 10. To control this control valve VC, the pumping installation IP according to this third embodiment of the present invention likewise comprises a control module MC. It is this control module MC which directs the operation of the control valve VC so that it can regulate the flow of the gases between the conduit LP1 and the conduit LP2 and thus between the enclosed volume VE and the outlet of the pumping installation IP. To this end, a fifth LP5 leading directly to the outlet of the pumping installation IP can also be provided at the outlet of the control valve VC.

It is thus apparent that the pumping installation IP according to this third embodiment of the present invention corresponds substantially in its structure to the pumping installation IP of the first embodiment of the present invention, represented in FIG. 1. However, the operation of the pumping installation IP according to this third embodiment differs significantly from the operation of the pumping installation IP according to the first embodiment of the present invention.

In fact, during the start-up of the pumping installation IP according to this third embodiment of the present invention, represented in FIG. 9, the control valve VC is closed, that is to say it is arranged not to allow the flow of gases between the first positive-displacement machine 10 and the second positive-displacement machine 20 through the conduit LP3. At this moment, the positive-displacement machine 10 and the positive-displacement machine 20 can be started up according to the known procedures. Consequently, thanks to the fact that the positive-displacement machine 10 is connected directly to the enclosed volume VE, the gases enclosed in the enclosed volumes VE can be evacuated by means of the positive-displacement machine 10. During this time, all these pumped gases exit the pumping installation IP by means of the conduit LP5.

The diagram represented in FIG. 2 illustrates the development of the pumping capacity (or "the pumping rate" of the pump) in the enclosed volume VE which is evacuated solely with the first positive-displacement machine 10, and a schematic representation of the development of the temperature in the first positive-displacement machine 10 which corresponds to the pumping capacity of this first positive-displacement machine 10 of FIG. 2 is shown in FIG. 3. These two diagrams thus also correspond to data which are obtained in the case which has been described with respect to the first embodiment of the present invention.

Coming back to these two diagrams, it can be noted that the pumping capacity increases in a first operating range, that it decreases in a second operating range, and that it remains constant after having attained a pressure limit. As concerns FIG. 3 and the development of the temperature in the first positive-displacement machine 10, it is easy to note a clear increase in the temperature of the positive-displacement machine 10 starting with a pressure limit. As already mentioned in the introduction, a large increase in the temperature is generally disadvantageous.

To overcome this problem of temperature, the third embodiment of the present invention, as with the first embodiment of the present invention, also proposes to control the control valve VC by means of the control module MC to switch the flow of gas between a first course in which the gas is pumped solely by the first positive-displacement machine 10 and a second course in which the gases pumped at the same time by the first positive-displacement machine 10 and the second positive-displacement machine 20. Nevertheless the manner of achieving this control in the pumping installation IP according to the third embodiment of the present invention differs from the way used in the pumping installation IP according to the first embodiment of the present invention.

Instead of a pressure sensor, however, the pumping installation IP according to the third embodiment of the present invention uses a temperature sensor TP placed at the outlet of the first positive-displacement machine 10. This temperature sensor is able to measure the temperature of the gases at the outlet of the first positive-displacement machine 10 and to transmit this thermal data to the control module MC so that it is able to control the control valve VC.

The control of the control valve VC functions in the following manner: While the temperature sensed at the outlet of the first positive-displacement machine 10 remains below a predetermined value, the control valve VC remains in the initial position, that is to say with the conduit LP3 closed, and with the release of the pumped gases from the enclosed volume VE through the conduit LP5. Of course the temperature limit can be selected in a "dynamic" way, that is to say depending on the gases pumped, to ensure that the temperature at the outlet of the first positive-displacement machine 10 does not surpass the critical value which would result in chemical and/or physical reactions of the pumped gases and residues inside the positive-displacement machine 10. This temperature limit can in particular be determined in a practical way for each concrete application and stored in the control module MC in order to be able to be used in the control of the control valve VC.

It must be noted here that, during this first phase of operation of the pumping installation IP, the second positive-displacement machine 20 is also running, even if it is connected to conduit LP3 which does not contain gas to be pumped (since the control valve VC closes this conduit here). Consequently, this second positive-displacement machine 20 tends to heat up.

When a temperature above the predetermined temperature limit is detected by means of the temperature sensor TP at the outlet of the first positive-displacement machine 10, the control module MC can control the control valve VC so that it opens the conduit LP3 for passage of the gases exiting from the first positive-displacement machine 10 and passing through the conduit LP2. At the same time, the conduit LP5 is closed. Starting from this moment, the gas is pumped at the same time by the first positive-displacement machine 10 and the second positive-displacement machine 20. This second positive-displacement machine 20 thus stops pumping out of an empty conduit LP3 and its temperature tends to drop to attain the optimal working temperature.

Of course the second positive-displacement machine 20 in such a configuration is susceptible to overheating, all the more so as it is normally desirable to use a "small" machine with dimensions which are reduced to the maximum. To prevent this problem, this second positive-displacement machine 20 can comprise a more or less sophisticated cooling mechanism CM. It is in particular possible to use a "conventional" air-cooling system, a water-cooling system (or another suitable liquid), or any other known system. This cooling mechanism CM can also be dynamic, i.e. be controlled by means of a temperature sensor (independent of the sensor TP) to release the coolant only if the temperature of the second positive-displacement machine surpasses a predetermined value.

The result of this control with respect to the development of the pumping capacity in the enclosed volume VE can be seen in FIGS. 6 and 7 (which also correspond to the behaviour of the pumping installation IP according to the first embodiment of the present invention).

To complete this description, it must be mentioned that a fourth embodiment of the present invention is shown in FIG. 10. With respect to the third embodiment of the present invention, this fourth embodiment of the present invention, as with the second embodiment of the present invention (cf. FIG. 8), also comprises a third positive-displacement machine 30 (typically a Roots pump) which is interposed between the enclosed volume VE and the first positive-displacement machine 10. The operation of the third positive-displacement machine 30 correspond to the operation of a "booster" pump which is used in a conventional way in the pumping installations known to date. It would of course also be possible to use another type of positive displacement machines or to add more of them, without departing from the spirit of the present invention.

Naturally the present invention is subject to numerous variations when implemented. Although several embodiments have been described, one understands that it is not conceivable to identify in an exhaustive way all the possible embodiments. It is of course conceivable to replace a described means with an equivalent means without departing from the scope of the present invention. Likewise, it is absolutely possible to combine the elements described with respect to the specific embodiments to thus create new embodiments of the present invention. We also wish to state that the different embodiments of the present invention can undoubtedly be combined to create other suitable embodiments. In particular, it is easily possible to realise a new pumping installation which comprises at the same time the main feature of the two first embodiments (i.e. a pressure sensor) with a temperature sensor such as proposed by the third and fourth embodiments of the present invention.

The invention claimed is:

1. Pumping installation comprising a first positive-displacement machine and a second positive-displacement machine, as well as a control module, in which pumping installation a gas is evacuated from an enclosed volume by means of the first positive-displacement machine and/or the second positive-displacement machine, wherein the pumping installation further comprises a 3-way control valve which is controlled by the control module and a pressure sensor at an outlet of the first positive-displacement machine, upstream of the control valve, and/or a temperature sensor at the outlet of the first positive-displacement machine, upstream of the control valve, in order to control the flow of said gas between the enclosed volume and an outlet of the pumping installation, and wherein the control valve is located at a junction of, and is able to switch the flow of said gas between, a first course in which the gas is pumped solely by the first positive-displacement machine and a second course in which the gas is pumped by the first positive-displacement machine and the second positive-displacement machine.

2. Pumping installation according to claim 1, wherein the first positive-displacement machine is a dry pump.

3. Pumping installation according to claim 2, wherein the first positive-displacement machine is a screw pump.

4. Pumping installation according to claim 1, wherein the second positive-displacement machine is a vane pump.

5. Pumping installation according to claim 1, wherein the pumping installation further comprises a third positive-displacement machine, connected in series between the enclosed volume and the first positive-displacement machine.

6. Pumping installation according to claim 5, wherein the third positive-displacement machine is a Roots pump.

7. Pumping installation according to claim 1, wherein the second positive-displacement machine comprises a cooling mechanism.

8. Method of control of a pumping installation comprising a first positive-displacement machine and a second positive-displacement machine, as well as a control module, in which pumping installation a gas is evacuated from an enclosed volume by means of the first positive-displacement machine and/or the second positive-displacement machine, wherein a 3-way control valve is controlled by the control module using data received from a pressure sensor at an outlet of the first positive-displacement machine, upstream of the control valve, and/or a temperature sensor at the outlet of the first positive-displacement machine, upstream of the control valve, in order to control the flow of said gas between the enclosed volume and an outlet of the pumping installation, and wherein the flow of said gas is switched by the control valve between a first course in which the gas is pumped solely by the first positive-displacement machine and a second course in which the gas is pumped by the first positive-displacement machine and the second positive-displacement machine, said control valve being located at a junction of said first course and said second course.

9. Method according to claim 8, wherein a third positive-displacement machine, connected in series between the enclosed volume and the first positive-displacement machine, is provided in the pumping installation.

10. Method according to claim 8, wherein, when the temperature sensed at the outlet of the first positive-displacement machine by the temperature sensor is below a predetermined value, the control valve blocks the passage of the gas through a conduit extending between the control valve and the second positive displacement machine.

11. Method according to claim 8, wherein, when a temperature above a predetermined temperature is detected by means of the temperature sensor at the outlet of the first positive-displacement machine, the control module controls the control valve to open a conduit extending between the control valve and the second positive displacement machine.

12. Method according to claim 11, wherein the predetermined temperature is chosen depending upon the gases pumped.

13. Method according to claim 11, wherein the predetermined temperature is determined in a practical way for each concrete application and is stored in the control module so as to be able to be used in the control of the control valve.

14. Pumping installation comprising a first positive-displacement machine and a second positive-displacement machine, as well as a control module, in which pumping installation a gas is evacuated from an enclosed volume by means of the first positive-displacement machine and/or the second positive-displacement machine, a valve system operable to switch the flow of gas from said enclosed volume between a first course in which the gas is pumped solely by the first positive-displacement machine and a second course in which the gas is pumped by the first positive-displacement machine and the second positive-displacement machine, said valve system consisting of a 3-way control valve;

said 3-way control valve being located at a junction of said first course and said second course;

said 3-way valve being controlled by the control module and a pressure sensor at an outlet of the first positive-displacement machine, upstream of the 3-way control valve, and/or a temperature sensor at the outlet of the first positive-displacement machine, upstream of the 3-way control valve.

* * * * *